United States Patent [19]

DiCicco

[11] 4,020,848

[45] May 3, 1977

[54] EAR LOBE PIERCING APPARATUS

[76] Inventor: Tripoli Joseph DiCicco, 79 Wilson Road, Concord, Mass. 01742

[22] Filed: July 25, 1973

[21] Appl. No.: 382,567

[52] U.S. Cl. ..... 128/330

[51] Int. Cl.[2] ..... A61B 17/34

[58] Field of Search ..... 128/329 R, 330, 334 R

[56] References Cited

UNITED STATES PATENTS

| | | | |
|---|---|---|---|
| 2,642,872 | 6/1953 | Parker | 128/330 X |
| 2,665,692 | 1/1954 | L'Esperance | 128/334 R |
| 2,798,491 | 7/1957 | Samuels | 128/330 |
| 2,853,074 | 9/1958 | Olson | 128/334 R X |
| 3,039,467 | 6/1962 | Stone et al. | 128/329 |
| 3,187,751 | 6/1965 | Coren et al. | 128/330 |
| 3,641,804 | 2/1972 | Oudenhoven | 128/330 X |

FOREIGN PATENTS OR APPLICATIONS

| | | | |
|---|---|---|---|
| 527,365 | 7/1956 | Canada | 128/330 |
| 2,597 | 1903 | United Kingdom | 128/330 |

*Primary Examiner*—Channing L. Pace
*Attorney, Agent, or Firm*—Cesari and McKenna

[57] ABSTRACT

Disclosed is an apparatus for piercing ear lobes and inserting therein two-piece ornaments. First and second jaws are adapted to receive the mating portions of the ornaments and each jaw positively positions the received portion of the ornament to insure precise alignment. The motion of the jaws relative to each other is restricted to one dimension and an actuator spring urges the first jaw toward the second. A trigger apparatus selectively overcomes the force of the actuator and thus controls the closing of the jaws. An auxiliary closure system, responsive to an auxiliary trigger, selectively linearly moves the second jaw so as to draw the jaws toward one another for proper positioning prior to piercing the ear in response to actuation of the trigger.

22 Claims, 16 Drawing Figures

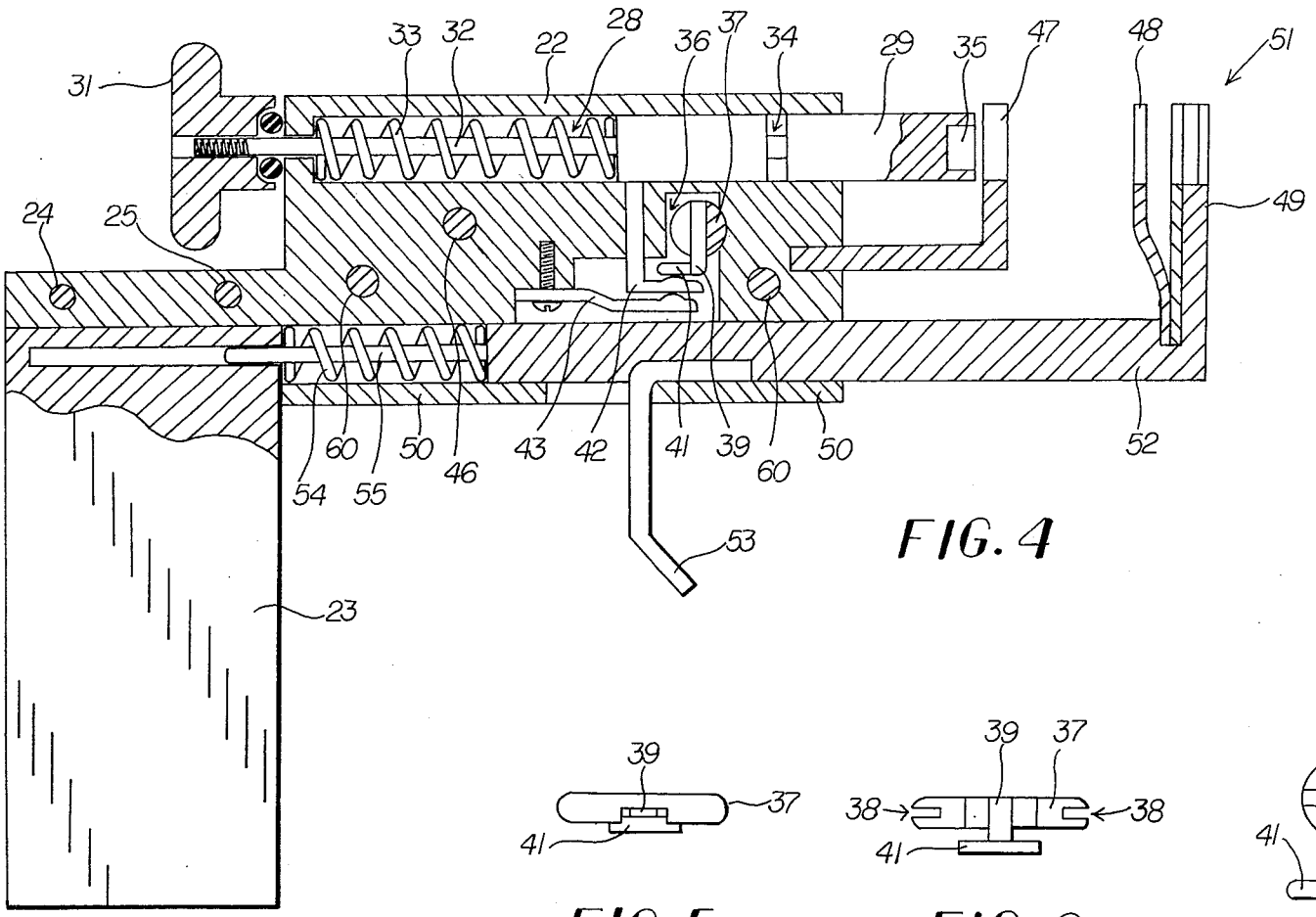
FIG. 4
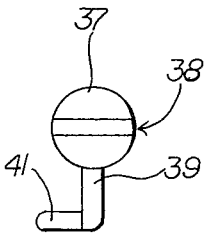
FIG. 7
FIG. 6
FIG. 5

EAR LOBE PIERCING APPARATUS

BACKGROUND OF THE INVENTION

This invention relates to apparatus for piercing ear lobes and, more particularly, to apparatus for piercing ear lobes and positioning ornaments in a single operation.

Ear lob piercing devices have long been known. The early ear lobe piercers generally comprised two crossed members coupled at a pivot point similarly to a pair of pliers. A problem with the early ear lobe piercers was that too much time and pain was involved in the piercing operation. The ear lobe first had to be pierced and then an object, such as a surgical suture, passed through the freshly made canal to keep it from closing as it healed. In time, the surgical suture method of preventing closure of the canal came to be replaced by the utilization of a two piece ornamental device. One portion of the device, called a wire, included a narrow wire or rod generally pointed on one end and affixed to an enlarged area or a small stone or gem on the opposite end. The mating portion, called a nut, was releasably clamped to the pointed end. Different methods of clamping were used. Sometimes the nut and wire were threaded or an annular groove near the pointed end of the wire sometimes cooperated with a resilient member in the nut.

When the use of a two-piece wire ornament became a popular method of preventing closure of the canel, ear piercers were devised in which the wire fitted directly into one of the piercing jaws and the wire itself created the canal. These devices provided a substantial time saving. A wire was fitted into the jaw and passed through the ear lobe and then, following separation of the piercing apparatus and the wire, a nut was applied to the wire.

Sometimes it is desired to pierce the ears of several persons in a single session. Inasmuch as any repetitive job can become physically fatiguing, ear piercing devices to ease the job of the person doing the piercing were devised. For example, the energy stored in a previously stressed spring was used to perform the piercing operation more quickly and effortlessly than can a person utilizing one of the prior pliers type apparatus. Furthermore, there is less likely to be pain for the patient. However, a problem with the early ear piercing devices was that the designers were greatly influenced by the pre-existing pliers type piercers. Rather than providing completely new apparatus,, the ear piercers designed were modifications of the pre-existing apparatus. For example, see U.S. Pat. No. 3,187,751. Observation of the referenced patent makes evident the result of this fidelty to the prior art. For example, observation of FIG. 1 will show the complex system required to convert the squeezing of two handles in an arcuate manner to linear motion between two jaws. Such complex equipment gave rise to a substantial degree of friction. Consequently, devices such as that depicted in the referenced U.S. Patent were difficult to operate repeatedly and operator fatigue remained a problem.

An object of this invention, therefore, is to provide a non-complex, reliable ear piercing apparatus that can be repeatedly operated without causing operator fatigue.

SUMMARY OF THE INVENTION

This invention is characterized by an apparatus for piercng ears and applying two-piece ornaments in the canals created. A jaw includes a wire retaining bore for retaining a wire portion of a two-piece ear ornament. A second jaw includes a nut retaining system for retaining a nut of a two-piece ear ornament. The nut retaining system includes a positioning slot that mates with shaped portions of the nut to precisely position and hold the nut during the piercing operation. The jaws are movable with respect to each other in only one dimension and an actuator spring urges the first jaw toward the second jaw. A trigger is utilized to selectively overcome the force of the actuator and retain the jaws in a separated position. When the apparatus is cocked, as explained below, proper actuation of the trigger releases the first jaw which then snaps toward the second jaw under the influence of the actuator spring.

The operation of piercing ears and placing in the newly created canal a two-piece ornament is greatly facilitated by the subject apparatus. That is because the positioning system in the second jaw holds the nut in precisely the right position to receive the wire as the canal in the ear lobe is formed. Preferably, the ornament used is of the configuration wherein spring loaded members in the nut cooperate with an annular groove near the pointed end of the wire. Consequently, the operation of piercing the ear and placing an ornament therein is rapidly completed. The actuator spring drives the wire through the ear lobe and into the nut. As will be explained more fully below, the ornament is easily released from the apparatus and exerts little pulling on the ears. Restricting the relative jaw motion to one dimension greatly facilitates the rapid ear piercing operation by contributing to the precision juxtaposition in which the wire and the nut must be held if they are to meet and mate properly following the forcing of the wire through the ear lobe. This is particularly important in this application due to the small size of human ear ornaments.

The apparatus is preferably of a pistol shaped configuration. The pistol shape is comfortable to hold and thus facilitates repeated operation. Furthermore, as will be explained below, a cocking operation is part of the ear piercing sequence. The pistol grip configuration provides a firm, secure one-handed grip so that the operator can easily cock the instrument with his remaining hand. Cocking the prior apparatus was less convenient. For example, refer to the above referenced U.S. Patent. To cock the instrument shown there, the handles must be drawn together to provide a secure hold, and then the handles must be separated prior to the piercing operation.

A feature of the invention is the inclusion of a closure system responsive to an auxiliary trigger for selectively drawing the second jaw nearer to the first jaw independently of the actuator system. The motion of the second jaw is, of course, in the one dimension that is permitted to the first jaw so that proper alignment of the jaws is preserved. A bias spring in the closure system urges the jaws apart and the auxiliary trigger is utilized to selectively overcome the force of the bias spring and draw the jaws together. The closure system results in a more accurate location of the canal in the ear lobe because after the insertion of the ear lobe between the two jaws, the jaws are drawn together and, being closer to the ear lobe, can be located more precisely with respect thereto prior to piercing.

Another feature of the invention is the inclusion of ear positioning plates between the jaws. At least one plate is resilient. The positioning plates include openings to permit the wire to pass therethrough. Furthermore, at least one of the plates responds to the auxiliary trigger and, when the closure system is activated, the positioning plates gently squeeze the ear lobe. Consequently, yet more accurate location of the canel is possible. This is so because the ear lobe is lightly squeezed by the plates so that the surface thereof expands as it it were being slightly stretched. Furthermore, the plates hold the ear lobe in a fixed relationship with the jaws during the piercing operation.

Yet another feature of the invention is a block adapted to hold the ear ornaments prior to use thereof and permit the ornaments to be placed directly into the piercing instrument without intermediate handling. Thus, the ornaments and the block can be sterilized prior to supply and, inasmuch as the ornaments need not be touched to be placed in the instrument, continued sterility is facilitated.

DESCRIPTION OF THE DRAWINGS

These and other features and objects of the present invention will become more apparent upon a perusal of the following description taken in conjunction with the accompanying drawings wherein:

FIG. 4 is an elevation sectional view of the apparatus depicted in FIGS. 1–3;

FIGS. 5, 6 and 7 show different detail views of a trigger connecting rod and actuator combination that is used in the preferred ear piercing instrument;

DESCRIPTION OF THE PREFERRED EMBODIMENTS

Figure 1:
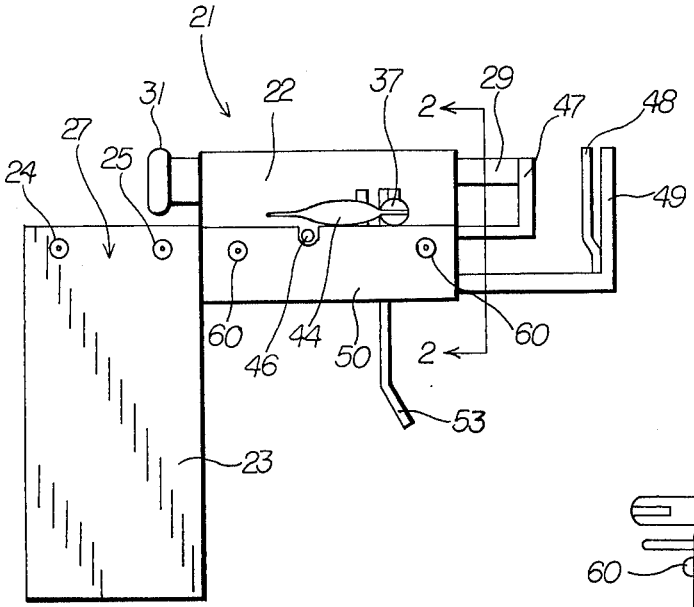
FIG. 1 is an elevation view of a preferred ear piercing instrument.
Figure 2:
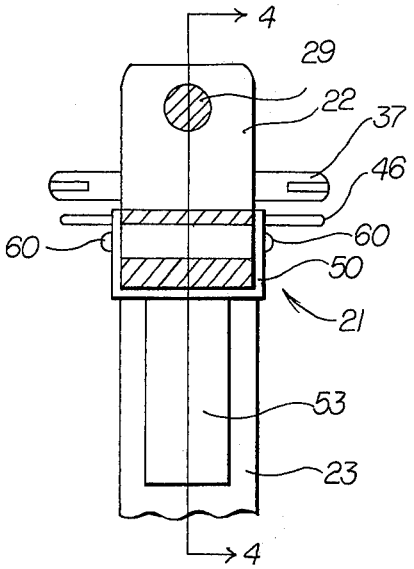
FIG. 2 is an elevation sectional view of the instrument shown in FIG. 1 taken along the line 2—2 therein.

The ear piercing instrument 21 will be described generally with respect to FIGS. 1, 2, 3, and 4. The instrument 21 is pistol shaped and includes a body portion 22 affixed to an elongated handle 23 by two rivets 24 and 25 passing through tabs 26 and 27 in the handle 23 and the section of the body 22 therebetween. A bore 28 in the body 22 retains a plunger 29 with a handle 31 screwed to one end thereof. A narrowed portion 32 of the plunger 29 is surrounded by a motive actuator spring 33 that urges the plunger 29 toward the right as viewed in FIG. 4. An annular groove 34 is defined by the plunger 29. Furthermore, the end of the plunger 29 toward the right as viewed in FIG. 4 is a first jaw and defines a wire retaining bore 35.

A generally rectangular opening 36 in the body 22 retains a trigger connecting rod 37. The rod is cylindrical and is held in place by one portion of the opening 36 that is curved. Detailed views of the rod 37 are found in FIGS. 5, 6, and 7. At each end of the rod 37 is a slot 38 and the central portion of the rod is notched. Thus the appearance of the rod 37 in FIG. 4 will be appreciated. Affixed to the notched portion of the rod 37 is a connecting bar 39 with an actuator foot 41. The connecting bar 39 and the notched portion of the rod 37 are narrow because it is preferable that as much of the rod contained within the opening 36 as possible be cylindrical in shape to insure that the rod is properly held in place. However, the actuator foot 41 is preferably nearly as wide as the body 22. An L-shaped latch member 42 is retained in another slot in the body 22 and the latch is biased in an upward direction by a flat spring 43. It will be appreciated that part of the L-shaped latch member 42 contacts the actuator 41 and thus, as viewed in FIG. 4, the spring 43 also urges the trigger connecting rod 37 in a clockwise direction. When the handle 31 is drawn to the left (as viewed in FIG. 4) the annular groove 34 will become aligned with the latch member 42. At that time, the spring 43 will drive the latch member 42 into the groove 34 and rotate the connecting rod 37 in a clockwise direction. Thus, the plunger 29 will be held in an active cocked position with the actuator spring 33 compressed.

Figure 3:
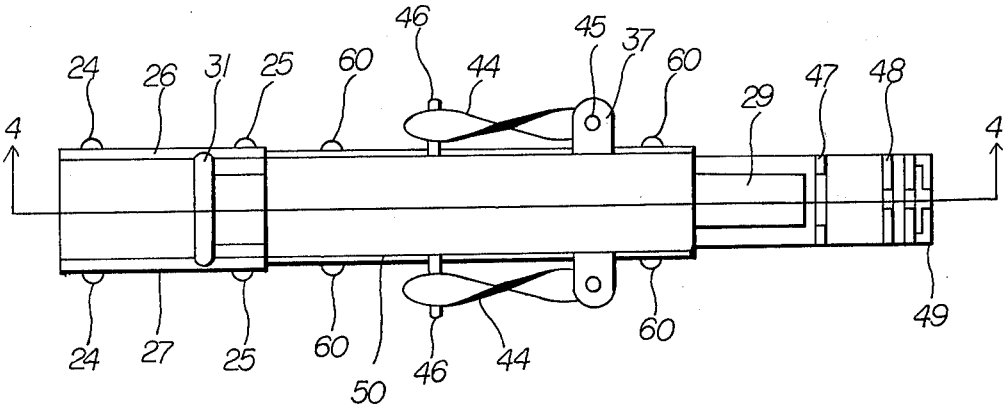
FIG. 3 is a plan view of the apparatus shown in FIG. 1.

Referring now to FIG. 3 there are shown dual triggers 44 that are strips of metal twisted 180 degrees for rigidity and are received by the slots 38 in the rod 37. Small pins 45 passing through the rod 37 and the triggers 44 are preferably included to securely affix the triggers to the rod. A stop 46 passes through the body 22 and is positioned to be just below the triggers 44 when the plunger 29 is in the uncocked position as shown in FIG. 4. When the rod 37 is rotated cockwise due to cocking the plunger 29, the ends of the triggers 44 separate from the stop 46. Depressing either trigger 44 toward the stop 46 will withdraw the latch member 42 from the annular slot 34 and permit the actuator spring 33 to drive the plunger 29 to the right.

As viewed in FIGS. 1, 3 and 4, a first positioning plate 47 is disposed to the right of the wire retaining bore 35. It will be appreciated that the plate 47 is affixed to the body 22. To the right of the first positioning plate 47 is a second position plate 48, that is preferably composed of resilient material such as spring steel. To the right of the second positioning plate 48 is a second jaw with a nut retaining mechanism 51.

A mounting bar 52 supports the second positioning plate 48 and the second jaw 49 and is coupled to an auxiliary closure trigger 53 for alternately drawing together or separating the first and second jaws 29 and 49. A bias spring 54 surrounding a rod 55 projecting from the end of the bar 52 urges the bar and thus the auxiliary trigger 53 to the right. Drawing the auxiliary trigger 53 to the left (as viewed in FIG. 4) linearly draws the second positioning plate 48 and the second jaw 49 toward the first positioning plate 47 and the wire retaining bore 35. The bar 52 is held in place by a U-shaped channel 50 affixed to the body 22 with rivets 60. An opening in the channel accommodates the auxiliary trigger 53 and permits it to move.

Figure 8:
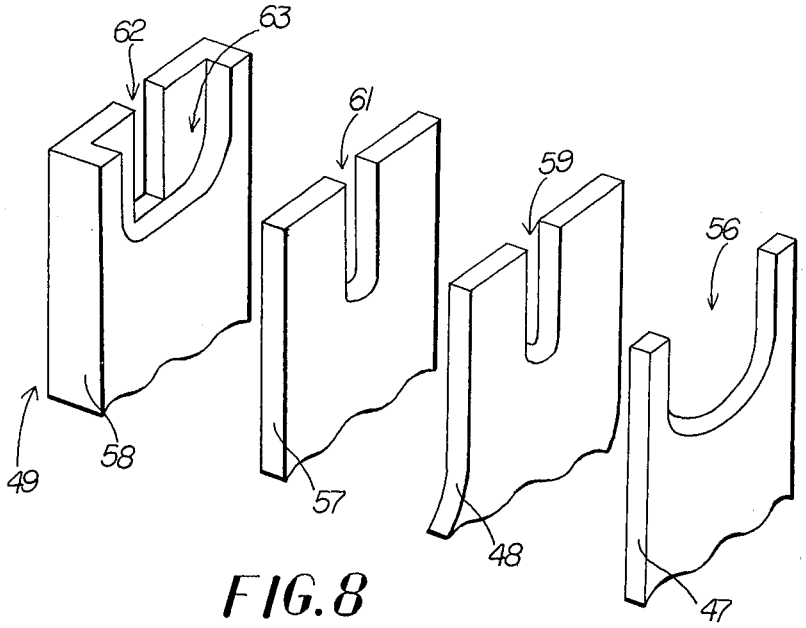
FIG. 8 is an exploded isometric view of a nut retaining apparatus and two pressure plates utilized in the preferred ear piercing apparatus.

Referring now to FIG. 8 there is shown an exploded view of the first positioning plate 47, the second positioning plate 48 and the second jasw 49. The first positioning plate 47 defines a large opening 56 that is preferably wider than the diameter of the wire retaining bore 35. The second jaw 49 is composed of a first metal plate 57 and a second metal plate 58 that are laminated during construction. The second positioning plate 48 and the first metal plate 57 retain slots 59 and 61 respectively, the function of which will be explained below. A slot 62 is cut in the second metal plate 58 and a larger slot 63 is cut in one portion thereof.

Figure 9:
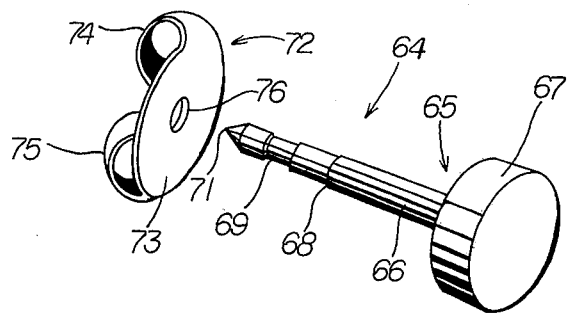
FIG. 9 is an isometric view of a two-piece ear ornament.

Referring now to FIG. 9 there is shown a two-piece ear ornament 64 of the type that is used with the apparatus 2. A wire stud 65 includes a wire portion 66 and a larger head portion 67. A shoulder stop 68 is defined by a wire 66 as is an annular groove 69. A pointed end 71 is opposite the head 67. A nut 72 includes a generally disc shaped body 73 with two resilient spring tabs 74 and 75. An opening 76 is defined by the disc 73. When the ear ornament 64 is assembled the pointed end 71 passes through the opening 76 and the wire portion 66 is moved through the opening 76 until the shoulder stop 68 contacts the disc 73. Thus,, the nut 72 is prevented from sliding too far toward the head 67. Just prior to the disc 73 contacting the surface 68, the tabs 74 and 75 are received by the annular groove 69 and thus the two-piece ornament 64 is releasably locked together. The two pieces are separated merely by grasping and pulling them apart.

Figure 10:
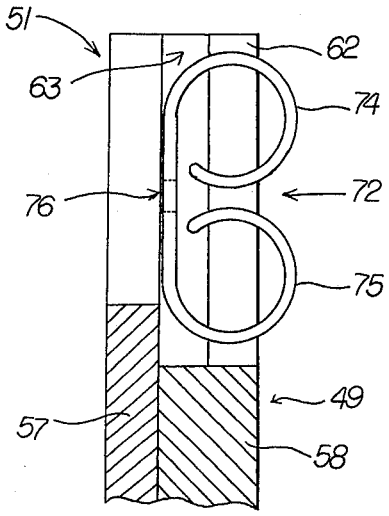
FIG. 10 is an elevation sectional view of the nut retaining apparatus with the nut therein.
Figure 11:
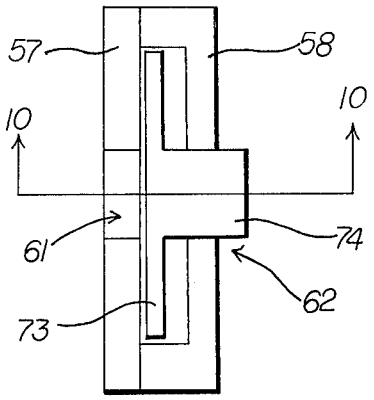
FIG. 11 is a plan view of the nut retaining apparatus and nut as shown in FIG. 10.

Referring now to FIGS. 10 and 11 there is shown the nut 72 in the nut retaining apparatus 51. It will be observed that the disc portion 73 fits in the large opening 63 between the first plate 57 and the second plate 58. Furthermore, precise alignment both vertically and horizontally is provided by the cooperation of the spring tabs 74 and 75 and the narrow slot 62. Thus, the positioning of the opening 76 is precisely determined with respect to the instrument 21 and the nut 72 is positively retained in all but a vertical release direction defined by the opening 63. It will be appreciated that the opening 76 is accessible through the slot 61 in the first plate 57.

Figure 12:
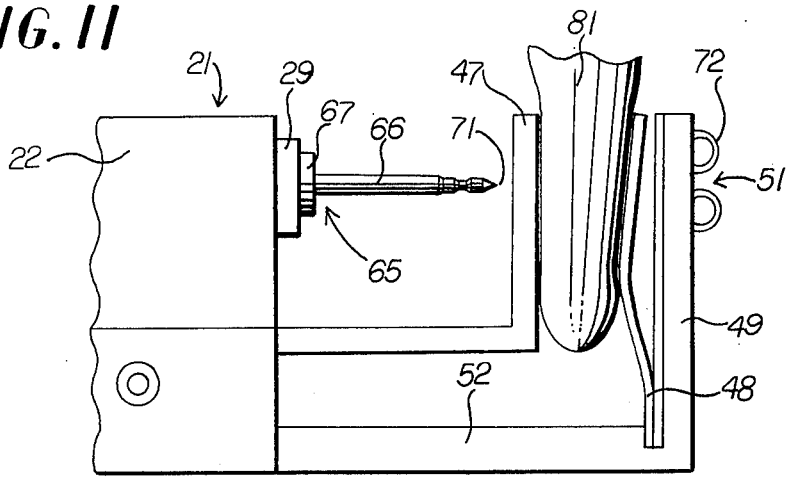
FIG. 12 is a detail view of a portion of the preferred ear piercing apparatus with an ornament inserted therein and an ear lobe in position for piercing.

Referring now to FIG. 12 there is shown the front portion of the apparatus 21 with the plunger 29 drawn back into the cocked position with the latch member 42 in the annular groove 34 (FIG. 4). Furthermore, the auxiliary trigger 53 has been drawn back toward the elongated handle 23 thus drawing the second positioning plate 48 and the second jaw 40 toward the first positioning plate 47. Consequently, the resiliency of the second positioning plate 48 provides a gentle squeezing effect on an ear lobe 81 placed between the positioning plates. The squeezing slightly expands the surface of the lobe 81 in the area that the canal is to be made. Thus greater accuracy in positioning the canal can be achieved. Furthermore, the lobe 81 is gently held in position with respect to the apparatus 21, further enhancing the accurate positioning of the canal. The position shown in FIG. 12 is with the auxiliary trigger 53 fully drawn. The positioning plates 47 and 48 are positioned so that ear lobes will not be excessively squeezed by the actuation of the auxiliary trigger 53. Utilizing the resilient second positioning plate 48 insures comfort for the patient.

Either of the triggers 44 (FIG. 3) is now actuated, withdrawing the latching member 42 from the annular groove 34. The released spring 33 snaps the plunger 29 toward the nut 72. Durng actuation movement of the spring between its cocked and released conditions, the wire portion 66 is rapidly driven through the ear lobe 81 in a quick and painless piercing operation. The plunger 29 stops prior to contact between the lob 81 and the head 67 of the wire 65. Thus the lobe 81 is not squeezed by the head 67. However, prior to the end of plunger motion the pointed end 71 of the wire 65 enters the opening 76 in the nut 72 and the wire 65 is fastened to the nut.

Following piercing the auxiliary trigger 53 is released, thus separating the positioning plates 47 and 48 and releasing the now pierced ear lobe 81. It will be recalled that the opening 56 in the first positioning plate 47 (FIG. 8) is larger than the diameter of the bore 35. Thus, a slight motion of the pierced ear toward the right with respect to the instrument 21 (as viewed in FIG. 12) will remove the head 67 from the wire retaining bore in the plunger 29. Inasmuch as the openings in the second positioning plate 48 and the second jaw 49 are all slots, simply moving the ear lobe 81 in a vertical release direction with respect to the apparatus 21 releases the pierced ear lobe and the two-piece ornament 64 thereon from the apparatus 21. The ornament is left in place until the canal heals.

Figure 13:
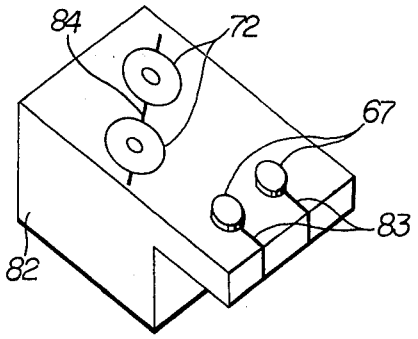
FIG. 13 is an upper isometric view of a resilient block retaining two two-piece ornaments.
Figure 14:
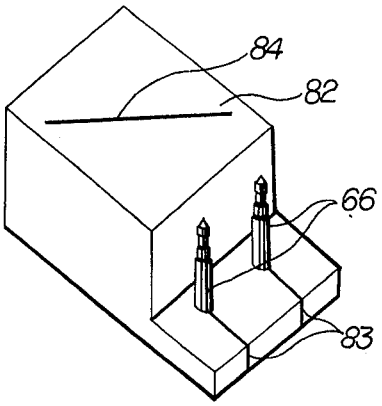
FIG. 14 is a lower isometric view of the block depicted in FIG. 13.

Referring now to FIGS. 13 and 14 there is shown a resilient holdinbg block 82 for holding the two-piece ear ornaments 64 prior to use. Two slots 83 that intersect three surfaces of a narrow end of the block 82 retain the wires 65. Another diagonal slot 84, shown as passing entirely through a thicker portion of the block 82, retains two nuts 72. The block 82 and the two ornaments 64 are sterilized prior to packaging and packaged so as to remain sterile during subsequent delivery. For example, the block 82 with the ornaments therein can be sterilized and sealed in a plastic bog.

Figure 15:
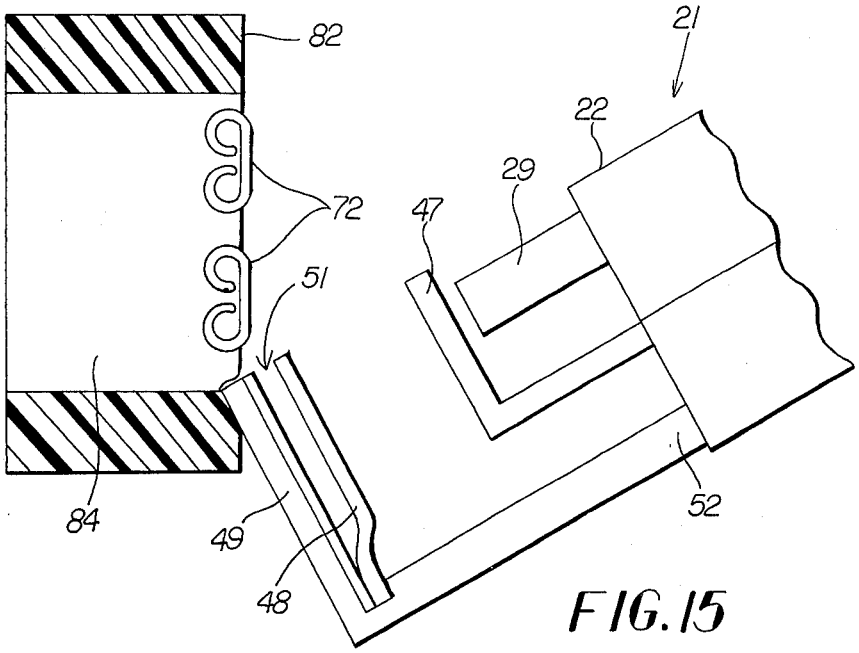
FIG. 15 is a detailed partially sectioned view showing the method of removing the nut from the block with the nut retaining apparatus.

Referring now to FIG. 15 there is shown a sectional view of the block 82 and a portion of the ear piercing apparatus 21. It will be appreciated that the section through the block 82 is taken diagonally so as to be parallel to the slot 84. Thus, the position of the nuts 72 retained in the slot 84 is clearly shown. When the apparatus 21 is placed in the juxtaposition with respect to the block 82 shown, the end of the jaw 49 slightly depresses a portion of the resilient block 82 and a scooping motion with the apparatus 21 will place one of the nuts 72 in the nut retaining apparatus 51 without the necessity of removing the nut 72 from the block 82 prior to placng it in the nut retaining apparatus. Thus the nuts 72 need not be separately handled.

Figure 16:
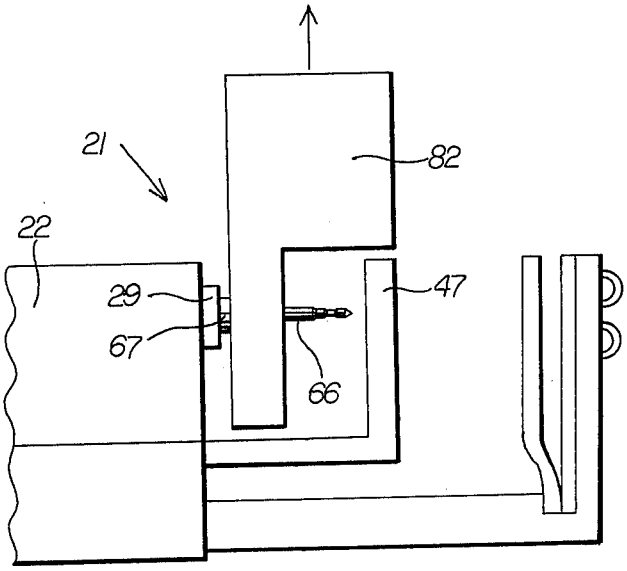
FIG. 16 is a detailed elevation view illustrating the method of placing the wires in the wire retaining apparatus from the block.

Referring now to FIG. 16 there is illustrated the method of inserting the wires 65 into the wire retaining bore 35 in the plunger 29. The apparatus 21 is cocked and the block 82 is placed in the position shown. The head 67 of a wire 65 is then moved into the bore 35 and drawing the block 82 in an upward direction, as indicated by the arrow in FIG. 16, permits the wire portion 66 to slide through the slot 83 (FIGS 13 and 14) and to be retained by the plunger 29. Thus the sterilized wires 65 need not be handled during the insertion operation.

In summary, the ear piercing operation comprises the following steps. The portion of the apparatus 21 near the two jaws and positioning plates that will contact the body of the patient is sterilized with, for example, alcohol. The apparatus 21 is then grasped in a manner similar to the way one holds a pistol. With the free hand, the handle 31 (FIG. 4) is drawn back to cock the apparatus. A sterilized nut 72 is transferred directly from the block 82 to the nut receiving apparatus 51 by the method depicted in FIG. 15. Inasmuch as the nut 72 is not touched, it remains sterile. Next, a sterilized wire 65 is inserted in the bore 35 according to the manner depicted in FIG. 16. Inasmuch as the wire 65 is not touched, it, too, remains sterile. An ear lobe 81 is then positioned as shown in FIG. 12 and the index finger of the operator draws the auxiliary trigger 53 back to slightly squeeze the lobe between the pressure plates 47 and 48. The thumb of the operator then actuates either of the triggers 44 and the plunger 29 snaps toward the second jaw 49, thus driving the wire 65 through the ear lobe 81 and into the nut 72. The operator actuates the trigger 44 nearest his thumb, which is determined by whether he is holding the instrument with his right or his left hand. Pressure on the auxiliary trigger 53 is then released and the pierced ear lobe and two-piece ornament 64 are separated from the apparatus 21 in an upward and outward motion.

Obviously, many modifications and variations of the present invention are possible in light of the above teachings. It is to be understood, therefore, that the invention can be practiced otherwise than as specifically described.

What is claimed is:

1. Apparatus for simultaneously piercing an ear lobe and engaging therein a two-piece ear ornament comprising a headed wire and a nut for engaging said wire, said apparatus comprising:

A. first jaw means for releasably holding a nut therein,

B. second jaw means apertured to provide passage of a headed wire therethrough and mounted for movement relative to said first jaw means to secure an ear lobe therebetween prior to piercing.

C. plunger means on said second jaw means actuatable independently of said first and second jaw means and adapted to hold a headed wire in alignment with said nut and the aperture in said second jaw, and D. triggered motive means for driving said plunger means toward said first jaw means to thereby drive a headed wire positioned in said plunger means through said ear lobe and into said nut when said jaw means are moved toward each other.

2. Apparatus accoring to claim 1 which includes a body mounting said first and second jaw means for slideable straight-line motion relative to each other.

3. Apparatus according to claim 2 which includes a spring normally urging said first jaw means outwardly of said body and compressible to allow closure of said jaws for engagement with an ear lobe.

4. Apparatus accordng to claim 3 which includes a trigger on said first jaw means providing a surface for engagement by an operator to move said jaws together.

5. Apparatus according to claim 4 which includes means on said body for limiting the minimum distance between said jaw means when said jaw means are moved together.

6. Apparatus according to claim 1 which includes a resilient wall connected on one of said jaw means and bendable toward said jaw means under a force applied thereto by said ear when said jaw means are moved together to secure said ear therebetween, said wall applying an increasing force to said ear as said jaw means move together.

7. Apparatus according to claim 1 in which said first jaw means includes means defining a slot for securing said nut therein and providing release of said nut by movement in the direction of said slot.

8. Apparatus according to claim 1 in which said triggered motive means comprises 1. a spring which is compressible by an operator to store energy therein,
2. cocking means for holding said spring in a compressed condition, and
3. a trigger actuatable to release said cocking means to thereby drive said plunger means toward said first jaw means.

9. Apparatus according to claim 8 in which said trigger includes first and second trigger arms mounted on opposite sides of said plunger means to facilitate operation thereof from either side of said plunger means.

10. Apparatus according to claim 1 which includes 1. an elongated handle for normal vertical disposition in a single hand of an operator, and
2. a body connected to said handle and extending generally orthogonal thereto, said body mounting said first and second jaw means thereon for straight-line motion relative to each other.

11. Apparatus according to claim 10 in which said body includes means defining a track for slideable motion of said first jaw means therein.

12. Apparatus according to claim 11 which includes a spring normally urging said first jaw means outwardly of said track and compressible to accomodate movement of said jaw means toward each other to secure an ear therein.

13. Apparatus according to claim 12 which includes a trigger connected to said first jaw means for engagement by the operator to move said jaw means together.

14. Apparatus according to claim 1 in which said first jaw means includes means defining a slot securing said nut and wire therein against withdrawal in the direction of motion of said plunger and facilitating withdrawal in a direction transverse thereto.

15. Apparatus according to claim 14 in which said plunger is mounted to extend a forward end thereof to a position closely adjacent said aperture, but not extending through said aperture, when said plunger is driven toward said first jaw means.

16. Apparatus for simultaneously piercing an ear lobe with a stud having an elongated shank and an enlarged head and engaging said shank in a nut, said apparatus comprising A. a first jaw 1. for positioning against one side of an ear lobe,
2. having means for releasably holding a nut therein B. a second jaw 1. for positioning against a second opposed side of said ear lobe,
2. having means forming an aperture therein of a size sufficient to accommodate passage of a headed stud therethrough, C. means for supporting a headed stud with its shank in alignment with said aperture and said nut, D. plunger means including
1. a plunger mounted in alignment with the aperture in said second jaw and with said nut for driving said shank through said aperture and into said nut,
2. a spring for driving said plunger toward said first jaw,
3. cocking means for holding said plunger in an energized position,
4. trigger means for releasing said cocking means to thereby free said plunger for driving said shank into said nut, E. means mounting said first and second jaws for movement toward and away from each other to engage an ear lobe therebetween when the jaws are moved toward each other, said headed stud remaining engaged with said nut after engagement therewith and passing through said aperture on movement of the jaws away from each other after releasing said trigger means.

17. Apparatus according to claim 16 in which said first jaw includes means forming a slot therein extending inwardly from an edge of said jaw for releasably holding said nut therein against movement in the direction of motion of said plunger.

18. Apparatus according to claim 17 which further includes a yieldable plate mounted on said first jaw and between said first and second jaw for applying an increasing force to an ear lobe placed between said jaws as said jaws are moved together, said plate having therein means forming a slot therethrough aligned with the slot on said first jaw for passage of said wire therethrough.

19. Apparatus according to claim 16 in which said second jaw comprises
1. a barrel in which said plunger is slideably mounted;
2. an apertured plate fixedly connected to said barrel and positioned intermediate said barrel and said first jaw lobe for contact with an ear when said jaws are moved together.

20. Apparatus according to claim 19 which further includes a handle connected to said second jaw and extending transversely therefrom to provide a grip for the user of said apparatus.

21. Apparatus according to claim 16 which further includes spring means normally urging said jaws apart and yieldable when said jaws are moved together.

22. An instrument for aligning and driving an earlobe piercing pin through an earlobe comprising;

first and second jaw means mounted for movement toward and away from each other;

means carried by said first jaw means for carrying and for driving a piercing pin having a head at one end and a pin at the other end along an axis which extends toward said second jaw means;

apertured means supported for movement in unison with said first jaw means, said apertured means positioned between said jaws in longitudinal alignment with and lying in a plane normal to said axis which extends toward said second jaw means, said apertured means having an inner area greater than the maximum area of said head of said piercing pin and support means interengaging said first jaw and said apertured means for positioning said apertured means sufficiently close to said second jaw means when said instrument is in its most closed position to firmly grip an earlobe therebetween and for allowing said apertured means to pass over a headed piercing pin in said instrument as said instrument moves from a closed to open position.

* * * * *